US005749301A

United States Patent [19]

Wronkiewicz et al.

[11] Patent Number: 5,749,301

[45] Date of Patent: May 12, 1998

[54] MULTI-RATE VERTICAL LOAD SUPPORT FOR AN OUTBOARD BEARING RAILWAY TRUCK

[75] Inventors: Robert D. Wronkiewicz, Park Ridge, Ill.; Terry L. Pitchford, St. Louis, Mo.; Daniel J. Schuller, Downers Grove, Ill.; Emmanuel Vander Vennen, Delran, N.J.

[73] Assignee: AMSTED Industries Incorporated, Chicago, Ill.

[21] Appl. No.: 713,869

[22] Filed: Sep. 13, 1996

[51] Int. Cl.[6] ..... B61F 5/00

[52] U.S. Cl. ..... 105/199.3

[58] Field of Search ..... 105/199.3, 199.4; 384/422, 423

[56] References Cited

U.S. PATENT DOCUMENTS

| | | | |
|---|---|---|---|
| 2,913,288 | 11/1959 | Blattner | 384/423 |
| 3,957,318 | 5/1976 | Wiebe | 105/199.3 |
| 4,030,424 | 6/1977 | Garner et al. | 105/182 R |
| 4,090,750 | 5/1978 | Wiebe | 384/423 |
| 4,434,720 | 3/1984 | Mulcahy et al. | 105/199 CB |
| 4,712,487 | 12/1987 | Carlson | 105/199.3 |
| 5,024,166 | 6/1991 | Ahlborn et al. | 105/453 |
| 5,086,707 | 2/1992 | Spencer et al. | 105/199.3 |
| 5,138,954 | 8/1992 | Mulcahy | 105/199.3 |
| 5,315,934 | 5/1994 | List et al. | 105/199.3 |

OTHER PUBLICATIONS

"Low-Dynamic-Action Grain Car"—Theta-80: The First Prototype *Progressive Railroading*, Feb., 1983.

*Primary Examiner*—Mark T. Le
*Attorney, Agent, or Firm*—Edward J. Brosius; F. S. Gregorczyk; Stephen J. Manich

[57] ABSTRACT

A constant-contact load-bearing assembly for a railcar truck bolster and operable against a complementary body bolster bearing and biased to continuously contact the body-bolster bearing to transfer the lading and railcar weight forces, which assembly has an outer element of a first coefficient of friction, a second or inner element with a second and larger coefficient of friction and biasing apparatus to maintain the inner assembly pad element in contact with the body-bolster assembly at an empty-railcar condition to provide control of the railcar body at the empty or unloaded car status with the biasing apparatus compressible at a loaded railcar state to provide contact between the outer pad element and the body-bolster bearing pad for transfer of the railcar loads and forces over the range of operating loads between the empty-car state and the loaded to capacity state.

14 Claims, 3 Drawing Sheets

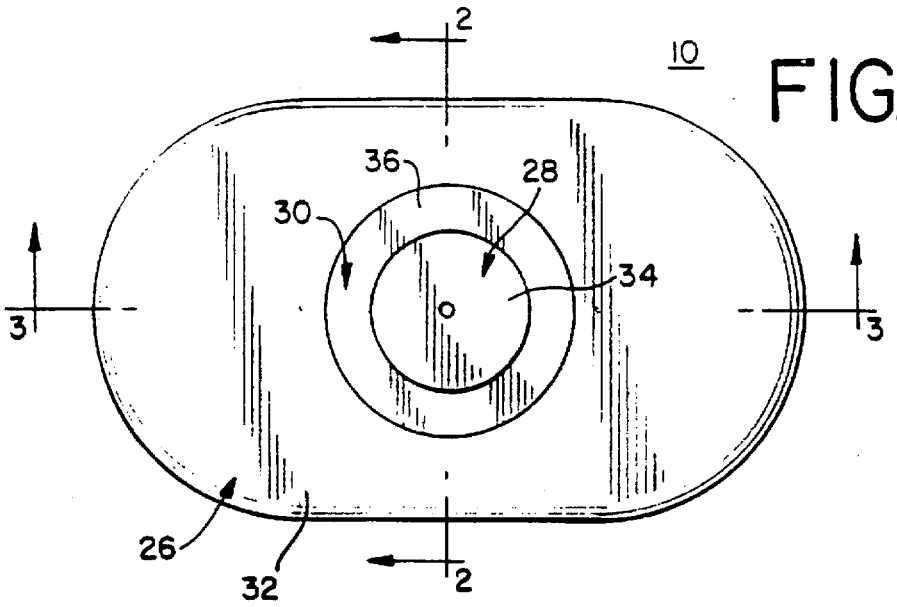
FIG. 1
FIG. 2
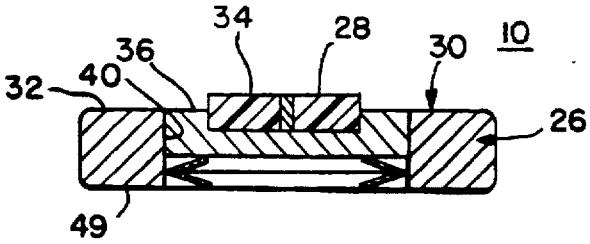
FIG. 3
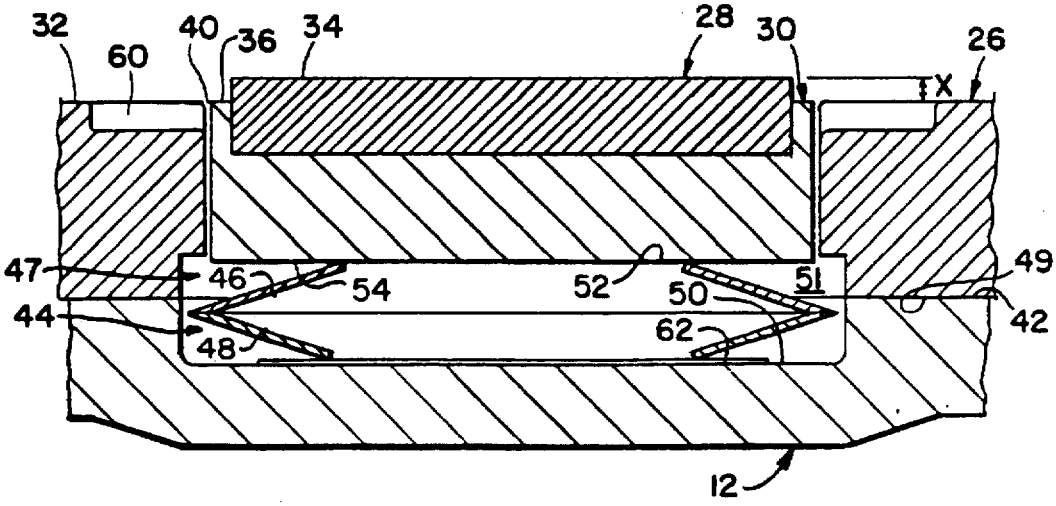

MULTI-RATE VERTICAL LOAD SUPPORT FOR AN OUTBOARD BEARING RAILWAY TRUCK

BACKGROUND OF THE INVENTION

Railway trucks generally include a truck bolster coupling a pair of side frames at their midpoints and include the wheels, axles, journal bearings, suspension systems and ancillary equipment. The railcars usually include a truck assemblies at either end of the railcar with the railcar body mounted on the truck bolsters at a body bolster. Railcars may broadly be classed into those with center-plate assemblies for the transfer of loads and control of car body and truck positions, and those with the load borne outboard of the center plate position. Both of these car types utilize side bearing assemblies between the car body bolster and the truck bolster, however, in the first noted railcar type the side bearings are utilized to avoid extreme displacement from car body roll, but in the second case the full weight of the railcar and lading is continuously borne by the side bearing assembly.

In general, the side bearing assemblies include an upper or body-bolster side bearing and a lower or truck-bolster side bearing, which upper and lower side bearings will be referred to as either a side bearing or side bearing assembly. In addition, the side bearings are usually paired, that is a first side bearing is provided between the truck bolster center and one of the side frames of the truck assembly and a second side bearing is provided equidistant to the first but between the truck bolster center and the other of the side frames.

In U.S. Pat. No. 4,030,424 to Garner et al., a rigid railway truck provides side bearing assemblies to bear the weight of the railcar, which bearing assembly is mounted over the spring assembly of the truck. This bearing assembly has a bearing guide which may be hollow or solid, but is illustrated with reinforcing ribs. A resilient support of an elastomeric member is mounted on the ribs and a bearing member is affixed atop the elastomer with a low friction bearing material on the bearing member. This laminate like bearing is provided in the disclosed truck on or over the side frame.

U.S. Pat. No. 5,024,166 to Alhborn et al. discloses a railcar truck assembly with the load borne outside the center plate region, however, the load is borne by leaf springs anchored outboard of the lateral cheeks but above the rails.

U.S. Pat. No. 4,434,720 to Mulcahy et al. teaches a multirate side bearing assembly for a railway truck with a center plate assembly, which carries and transfers most of the vertical load to the truck bolster and sideframes. In this apparatus, the side bearing is utilized to provide load support to a limited degree, but more importantly is utilized to damp car body-truck rocking motion. The apparatus includes alternative embodiments of laminate arrays of elastomers with intermediate solid plate-like structures. However, under an empty car condition it is considered that the bearing assemblies would support the weight of the railcar, at least in the static state. The second resilient device is mounted next to the first or empty-car resilient device, and this second device of greater compression and shear properties is fitted with wear plates at its top and bottom. The roll or yaw stiffness is generally provided by the second resilient device. At a loaded car state, the first resilient device is compressed, the second resilient device is contacted by the car body and the center plate contacts the truck bolster center-plate opening, which center plate is the primary force transfer mechanism in this car body and truck bolster arrangement.

U.S. Pat. No. 5,138,954 to Mulcahy discloses a railcar truck bolster with distal ends outboard of the truck side frames and having the car body weight at the side sills supported at these distal ends. The friction side bearings provide a combination pad with a major friction body of a relatively low friction material and at least one second friction body inserted in the low friction material, which second body is a relatively high friction material. The bearing embodiments illustrated and taught are in the form of an arcuate body to mate with a concave seat. These bearings will tilt in their seat to level themselves with the car body wear pad. This second friction body is dependent upon the first or low friction material for its relative position and maintenance of its base as the second friction body is only operable against the first friction body.

SUMMARY OF THE INVENTION

A constant-contact load-bearing assembly for a ligthweight railcar has a body-bolster bearing and a truck-bolster multi-element arrangement, which truck-bolster element is spring biased against the truck bolster and operable to continuously bear the car weight at either the loaded or empty state. The truck bolster load-bearing assembly has a first and outer element with a generally central passage therethrough. A second or inner element is provided in the central passage with a biasing spring in a recess in the truck bolster between the bolster and the inner element, which spring biases the inner element against the body-bolster side bearing. As a practical matter the body bolster most generally includes a wear pad to bear against the truck-bolster load-bearing assembly. At an empty-car state the wear pad abuts or contacts the truck-bolster bearing inner pad and the biasing spring supports the car body against contact with the truck bolster or side frame. At the loaded or partially loaded state, the railcar body bolster, and specifically the wear pad, compresses the truck-bolster inner pad and bias spring to contact the first or outer pad of polymeric material. This outer pad polymer does have a bulk modulus and is slightly compressible, but along with the similarly situated load-bearing assemblies, it will sustain the weight of the loaded railcar. The coefficient of friction of the outer pad polymer is substantially lower than the coefficient of friction of the inner pad material, which permits relatively unrestrained movement of the truck relative to the bolster especially during travel around curves. Although the inner pad is continuously biased against the wear pad, the primary load carrying function is accommodated by the outer pad, which load carrying function is understood to be related to the contact area of the truck-bolster outer pad with the body-bolster load bearing element.

BRIEF DESCRIPTION OF THE DRAWING

In the Figures of the drawing, like numerals refer to like components and in the drawing:

FIG. 1 is a plan view of the preferred embodiment of the truck-bolster load bearing assembly;

FIG. 2 is a cross-sectional view of the truck-bolster load bearing assembly of FIG. 1 taken along the line 2—2;

FIG. 3 is a cross-sectional view of the truck-bolster load bearing assembly of FIG. 1 taken along the line 3—3;

DETAILED DESCRIPTION OF THE PREFERRED EMBODIMENT

Figure 4:
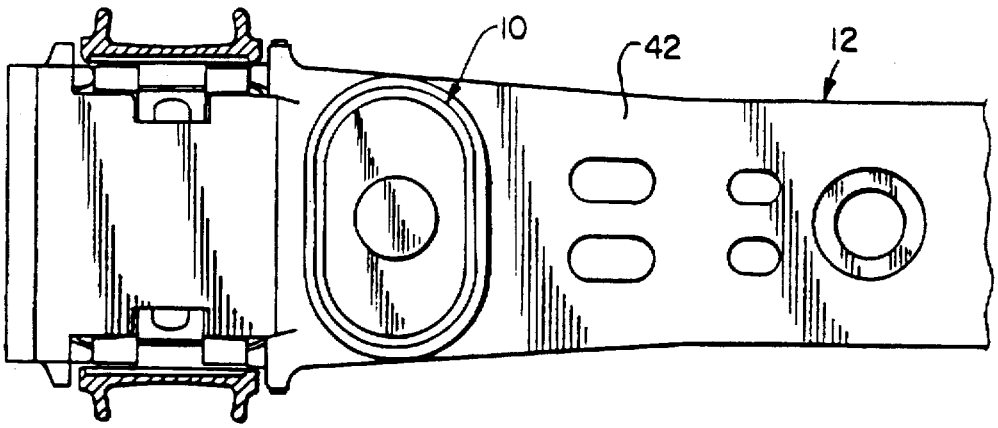
FIG. 4 is a plan view of an one-half of an exemplary truck bolster with the load bearing assembly in position.
Figure 5:
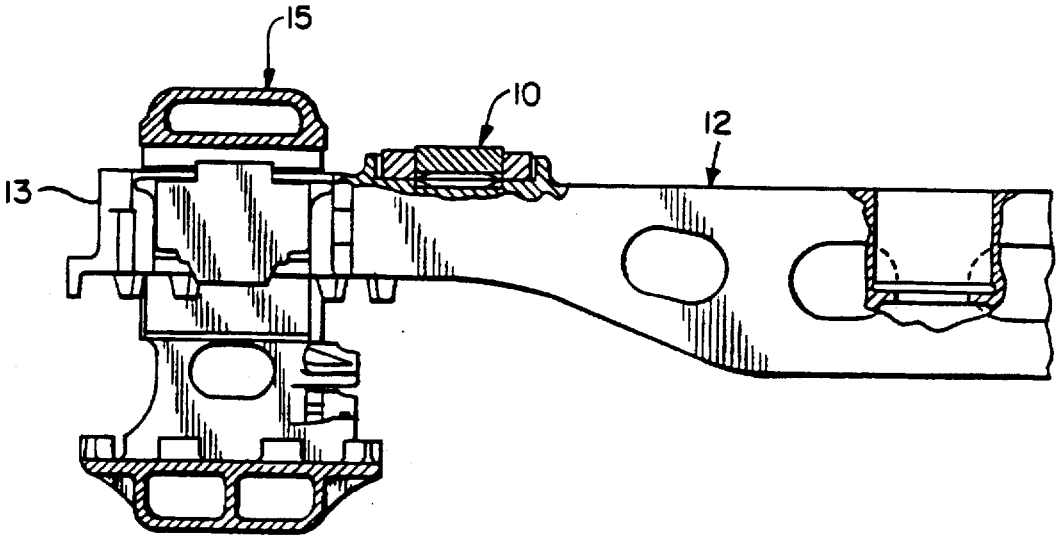
FIG. 5 is an elevational view in the railcar longitudinal direction of the half-bolster of FIG. 4.
Figure 8:
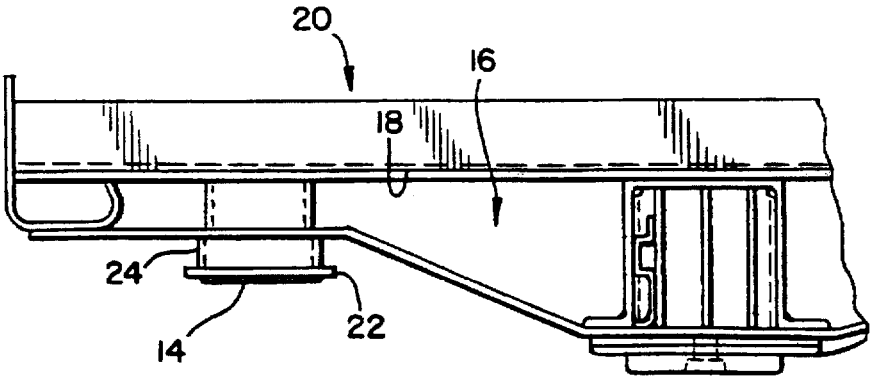

A constant-contact, spring-biased, dual coefficient of friction load-bearing assembly or pad 10 for one side of a railcar truck bolster 12 with one end 13 in a side frame 15 is illustrated in FIGS. 4 and 5. More specifically, load-bearing assembly 10, hereafter load bearing 10, is shown in enlarged detail in FIGS. 1, 2 and 3. A complementary body-bolster load bearing or pad 14 is illustrated in FIG. 8 and downwardly extends from body bolster 16 on bottom 18 of railcar body 20. Body-bolster pad 14 is secured to lower end 22 of load bearing support 24. The illustration of FIG. 8 is merely exemplary of a body-bolster load bearing structure and position, as the figure includes a center plate structure, which is not utilized with the present invention. Body bolster 16 and truck bolster 12 are generally aligned and parallel in a railcar assembly. In such assembly body-bolster pad 14 and truck-bolster load bearing 10 are generally vertically aligned for contact between pad 14 and load bearing assembly 10.

Although a railcar is not illustrated, it is known to have a longitudinal axis, a railcar body, a first end, a second end and generally a truck assembly at each of the first and second ends. A typical three-piece railcar truck assembly (not shown) has first and second side frames 15 connected by truck bolster 12. The complete truck assembly would include axles, wheels, springs and ancillary components, but these elements are not included within the present invention. Truck bolster 12 is either matable with or coupled to body bolster 16, thus connecting the truck assembly with railcar body 20.

In FIG. 1, load-bearing assembly 10 is shown with an elliptical shape, but this shape is merely illustrative, not a limitation. Load-bearing assembly 10 has a first and outer pad 26 of a material with a relatively low coefficient of friction in comparison to the coefficient of friction for the material of second or inner pad 28. Steel pad 30, which is generally centrally located in first pad 26, may be a mild steel and has second or inner pad 28 nested therein with upper surfaces 32 and 36 approximately coplanar, as an illustration not a requisite.

Outer pad 26 in FIG. 1 provides a base or housing-like support for inner pad 28 and is noted with a significantly greater area of bearing or top surface 32 than the combined areas of surfaces 34 and 36. This difference in area between surfaces 32 and 34,36 is illustrated herein, but is not a requirement for operation of the invention. Second bearing surface 34 of inner pad 28 has a significantly smaller surface and contact area than surface 32. In the complementary or contacting relationship between body-bolster pad 14 and truck-bolster pad 10, the mating surfaces 14, 32 and 34 may not be in a perfect mated relationship even at a reference position, that is with the empty railcar at rest, but the interaction between the surfaces for either the empty railcar or loaded railcar state is not dependent upon perfect mating of these surfaces.

In the preferred embodiment, second or inner pad 28 is nested in steel pad 30, which is slidably positioned for reciprocation in throughport 40 of first pad 26. The clearance between pad 26 and pad 30 in throughport 40 should be a minimal amount, but adequate to allow for sliding of pad 26 in throughport 40. This collection of elements 26, 28 and 30 are mountable on upper surface 42 of truck bolster 12 as noted in FIG. 3. In this figure, truck bolster 12 has recess 44 in upper surface 42, and in cooperation with undercut 47 in lower surface 49 of first pad 26 they provide cavity 51 to receive a first Belleville spring 46 and a second Belleville spring 48 serially arranged against the bottom 50 of recess 44. Although only first and second Belleville springs 46 and 48 are shown in the Figure, it is known that more and different types of springs may be utilized or accommodated in cavity 51 to bias pads 30 and 28, as required. Upper surface 52 of first spring 46 is in contact with lower surface 54 of steel pad 30, which springs 46 and 48 cooperate to bias steel pad 30 and second pad 28 into contact with body-bolster pad 14. In this illustration, first pad 26 has second undercut or relief section 60 at the intersection of surface 32 and throughport 40 for ease of assembly, operation of steel pad 30 and to inhibit migration of lubricant from surface 32 to second bearing surface 34.

At a reference state, the illustrated configuration of FIG. 3 has upper surface 34 displaced above first-pad upper surface 32 by a distance x. This separation or travel distance is the compression or travel available for second or inner pad 28 and 30 to control and maintain contact with body-bolster pad 14, and thus railcar body 20 at the empty railcar state. At a full or lading bearing state for railcar body 20, second pad 28 and steel pad 30 will be compressed against the bias force of springs 46 and 48, which have a spring rate great enough to bear the weight of the empty railcar. Pads or surfaces 26 and 28 are slightly compressible, but the compressibility or deflection from the illustrated state is a minimal compression and will not be further considered. At the loaded railcar state, pads 26 and 28 are in contact with body-bolster pad 14, which pads are considered relatively incompressible and provide a surface area large enough to sustain the weight of a fully loaded railcar.

In operation, there are broadly speaking two operational modes: the empty-railcar state, wherein the load or force is the weight of the railcar; and, the loaded or lading-bearing state wherein the load or vertical force is the sum of the railcar and lading weights. The preferred embodiment of truck-bolster load bearing pad 10 has first pad 26 of a low-coefficient-of-friction material, such as a thermoplastic with additions of Teflon and silicon. A plurality of tests of this product have shown a coefficient of friction of 0.10 and lower, and this product has sustained its operability over a testing period, which has not been previously sustainable with other known high-polymer products. It is known that low coefficient of friction measurements are attainable on a surface by lubricating the surface with a compound such as oil, however, only recently has the above-noted thermoplastic compound been provided, which would maintain a low coefficient of friction surface during an operating period and under operational conditions. Oil is not generally utilized between pads 14 and 26,28 as it may be squeezed from between the contacting surfaces, thereby obviating its lubricity; it retains grit between the pads thereby potentially increasing the coefficients of friction therebetween; and, it may deteriorate some polymeric pad materials.

Second or inner pad 28 is a second material, such as a urethane product with a coefficient of friction between about 0.18 and 0.24, which coefficient is also sustainable during operational conditions and for extended operating periods, not merely for a single test. An alternative second pad material may have a coefficient of friction greater than 0.18. It is the ability to maintain their relative coefficients of friction that now enable the present load bearing assemblies to be assembled and tested for manufacture and use. These pads 26 and 28 contact body-bolster pad 14, which may be a hard material such as stainless steel or another hard polymer, and continuously abrade against this pad 14. The continuous wear between the pad surfaces and the entrapment of tramp materials between these surfaces has historically abused and eroded these surfaces and increased the coefficient of friction of each of the surfaces. As a consequence, no known continuous contact load bearing assembly has maintained the low coefficient of friction requisite to continuous long-term operation.

In an alternative embodiment, wear plate 62 may be provided on recess bottom 50 to contact Belleville spring 48, which thus avoids direct wear on the surface of bottom 50. Wear plate 62 may be of any hard wearing material.

Figure 6:
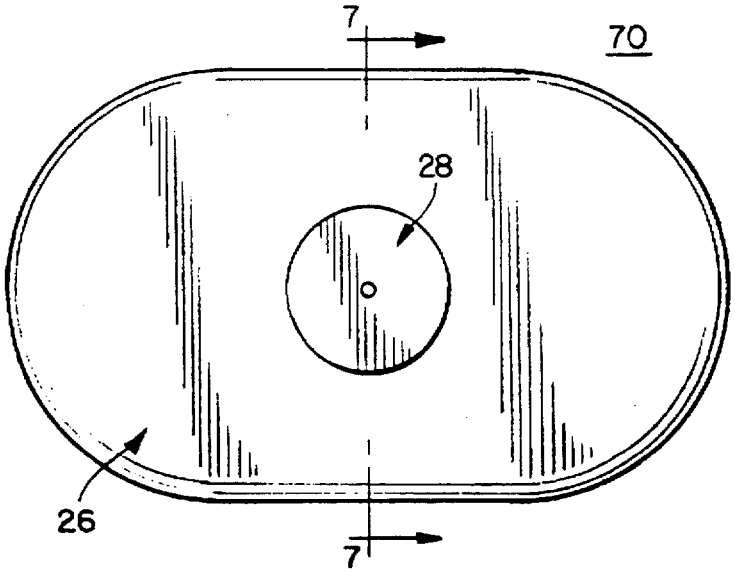
FIG. 6 is a plan view of an alternative load bearing arrangement.
Figure 7:
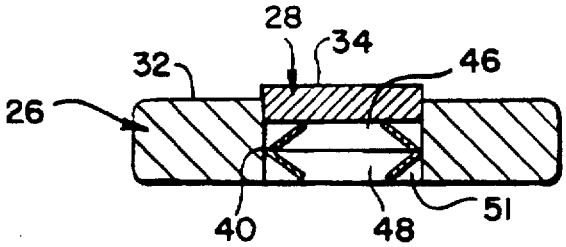
FIG. 7 is a cross-sectional view of the load bearing arrangement of FIG. 6 taken along the line 7—7; and, FIG. 8 is a front elevational view of one-half of a body bolster with an exemplary body-bolster load bearing pad.

In the alternative embodiment of FIGS. 6 and 7, load bearing assembly 70 has first pad 26 with passage 40. However, second pad 28 is directly nested in passage 40 and positioned against spring 46 in cavity 51. Second pad 28 may either a metal of an operable hard polymer. In addition, lower surface 54 in any of the embodiments may be hardened to inhibit wear between piston 30 and spring 46, as well as alternatively interposing a plate similar to plate 62 between surface 54 and spring 46.

The present invention provides a spring biased, constant-contact side-bearing assembly with a dual coefficient of friction pad surface from the utilization of separate materials for the empty or reference railcar state and the loaded or laden railcar state. The lower coefficient of friction material of pad surface 32 reduces the torsional resistance to turning between body-bolster pad 14 and truck bolster 12 to encourage ease of turning and cornering between a truck assembly and a railcar. Further, this constant-contact, dual-rate side bearing arrangement allows the introduction of a lower weight truck assembly and the elimination of the center plate assembly for the truck assembly, which is the predominant truck assembly structure presently in use in the United States.

Those skilled in the art will recognize that certain variations can be made in the illustrated embodiments. While only specific embodiments of the invention have been described and shown, it is apparent that various alterations and modifications can be made therein. It is, therefore, the intention in the appended claims to cover all such modifications and alterations as may fall within the true scope of the invention.

We claim:

1. A constant-contact load-bearing assembly between a truck bolster and a body bolster of a railcar, which body bolster has a lower side and at least one constant-contact, body-bolster, bearing with a wear surface mounted on said lower side, said truck bolster having an upper side and extending between a first side frame and a second side frame of a railcar-truck assembly, said constant-contact, load-bearing assembly comprising:

a first and outer pad of a first polymeric material with a first coefficient of friction, said first pad having a top surface, a bottom surface and defining a generally centrally located through-port;

a second and inner pad of a second material with a second coefficient of friction greater than said first coefficient of friction, said second pad having an upper surface and a lower surface, said second pad positioned and movable in said through-port;

means for biasing said second pad, which biasing means contacts said second pad lower surface to bias said second pad in said through-port;

said constant-contact, load-bearing assembly mounted on said truck bolster upper side and generally in vertical alignment with said body-bolster bearing, said load-bearing assembly having said first pad bottom surface mounted on said truck-bolster upper side, said biasing means positioned and operable between said second pad lower surface and said truck-bolster upper side to bias said second pad with said upper surface vertically displaced above said first pad top surface a predetermined distance at a reference position with said railcar nonladen, said second pad upper surface continuously contacting said body-bolster load-bearing wear surface, said second pad upper surface contacting said wearing surface to solely bear the weight and load forces of said railcar body at an empty-car state and deflectable against said biasing means to transfer said weight and load forces to said truckbolster with said higher coefficient of friction material in the unloaded and empty-car state, said biasing means deflectable at a loaded-car state to provide contact between said wearing surface and both of said first pad top surface and said second pad upper surface cooperating to bear the weight of said railcar body and lading at a loaded-car state to communicate said railcar body and lading weight to said truck bolster and side frames.

2. A constant-contact load-bearing assembly as claimed in claim 1 wherein said second pad is a steel cap.

3. A constant-contact load-bearing assembly as claimed in claim 1, said assembly further comprising a third polymeric material pad mounted on said second pad upper surface, which third polymeric material has a third coefficient of friction greater than said first-polymeric-pad-material first coefficient of friction.

4. A constant-contact load-bearing assembly as claimed in claim 1 wherein said biasing means is at least one spring.

5. A constant-contact load-bearing assembly as claimed in claim 1 wherein said biasing means is a spring assembly having a first disc spring and a second disc spring, each said spring having a spring rate, a top side and a bottom side, said springs having their top sides juxtaposed and cooperating to define said spring assembly.

6. A constant-contact load-bearing assembly as claimed in claim 1 wherein said truck bolster defines a recess in said upper side to receive said biasing means, and said through port is aligned with said recess.

7. A constant-contact load-bearing assembly as claimed in claim 5 wherein said truck bolster defines a recess with a bottom surface in said upper side to receive said spring assembly, said springs arranged in vertical alignment to provide said lower spring bottom side in contact with said recess bottom surface and said second spring top side in contact with said second pad.

8. A constant-contact load-bearing assembly as claimed in claim 5 wherein said first spring has a first spring rate and said second spring has a second spring rate;

said railcar at a reference position is at an unloaded and static state, and is operable between a loaded car state and said reference state, said second pad is a steel cap, said first and second springs operable to support said railcar and to bias said steel cap to provide said upper surface generally in alignment with said first pad top surface with said railcar at said loaded-car state.

9. A constant-contact load-bearing assembly as claimed in claim 8 wherein said first pad top surface has a first surface area, said railcar operable in a dynamic operating mode, said second pad upper surface having a second area, said first and second pad areas and said spring rates provided to support said railcar at said reference position and at said dynamic mode.

10. A constant-contact load-bearing assembly as claimed in claim 8 wherein said first pad has a first bulk modulus and said second pad has a second bulk modulus, said second pad and said bias means operable to support said railcar at a reference static and unloaded state, said first pad having a top surface with a first area, which first area and said first bulk modulus cooperate to provide means for supporting said railcar displaced from said truck bolster upper side at a loaded state.

11. A constant-contact load-bearing assembly as claimed in claim 10 wherein said first pad top surface at said reference position is at a first height above said truck bolster surface, said first pad first bulk modulus and first surface area are deflectable to a second height at a loaded car state, said second height less than forty-five thousandths below said first height.

12. A constant-contact load-bearing assembly as claimed in claim 3 wherein said second polymeric pad mounted on said steel-cap second surface has a third surface, said railcar operable between an unloaded state and a loaded state, said railcar at a reference position at an unloaded and static state, said third surface at a predetermined distance above said first pad surface at said reference state, and said bias means operable to maintain said third pad surface at said predetermined distance above said first pad first surface at said reference state.

13. A constant-contact load-bearing assembly as claimed in claim 12 wherein said bias means is compressible by said body-bolster bearing and railcar at a loaded car state to provide contact between said outer element and said body-bolster bearing for transfer of said load forces.

14. In a railcar operable to bear lading, said railcar having a body with at least one railcar truck assembly, at least one body bolster with a lower side and at least one body-bolster load bearing with a first wear surface, said railcar body and lading providing a vertical load transferrable to said truck assembly, said truck assembly having a truck bolster with an upper side, a first side frame, a second side frame and at least one constant-contact, truck-bolster load-bearing assembly operable to contact said body-bolster load bearing, said truck bolster connecting said first and second side frames, said truck-bolster load-bearing assembly comprising:

a first and outer pad of a first polymeric material with a first coefficient of friction, said first pad having a top surface, a bottom surface and defining a generally centrally located through-port;

a second and inner pad in said through-port, said second pad of a second material having a second coefficient of friction greater than said first coefficient of friction, an upper surface and a lower surface, said second pad positioned and movable in said through-port;

means for biasing said second pad, which biasing means contacts said second-pad lower surface to bias said second pad in said through-port;

said truck-bolster, constant-contact, load-bearing assembly mounted on said truck bolster upper side and generally in vertical alignment with said body-bolster load bearing, said truck-bolster load-bearing assembly having said first pad bottom surface to said truck-bolster upper side, a reference position for said railcar provided at an empty railcar condition, said biasing means positioned and operable between said second pad lower surface and said truck-bolster upper side to bias said second pad with said second-pad upper surface vertically displaced above said first-pad top surface a predetermined distance at said reference position, said second-pad upper surface at said reference position contacting said body-bolster, load-bearing wear surface to solely bear the weight and load forces of said railcar body, which second pad is deflectable against said biasing means to transfer said weight and load forces to said truck bolster with said higher coefficient of friction material in the unloaded and empty-car state, said biasing means deflectable by said second pad at a railcar laden state to provide contact between said body-bolster wearing surface and both of said truck-bolster first pad top surface and said second pad upper surface cooperating to bear and communicate the vertical load of said railcar body and lading at a loaded-car state to said truck bolster and side frames.

* * * * *